US005958848A

United States Patent [19]

Robson

[11] Patent Number: 5,958,848

[45] Date of Patent: Sep. 28, 1999

[54] LOW CHLORINE, LOW ASH CRANKCASE LUBRICANT

[75] Inventor: Robert Robson, Oxfordshire, United Kingdom

[73] Assignee: Exxon Chemical Patents, Inc., Linden, N.J.

[21] Appl. No.: 09/043,721

[22] PCT Filed: Sep. 24, 1996

[86] PCT No.: PCT/EP96/04258

§ 371 Date: Mar. 25, 1998

§ 102(e) Date: Mar. 25, 1998

[87] PCT Pub. No.: WO97/12016

PCT Pub. Date: Apr. 3, 1997

[30] Foreign Application Priority Data

Sep. 27, 1995 [GB] United Kingdom ..... 9519668

[51] Int. Cl.[6] ..... C10M 163/00

[52] U.S. Cl. ..... 508/232; 508/295; 508/399

[58] Field of Search ..... 508/232, 399, 508/295, 233

[56] References Cited

U.S. PATENT DOCUMENTS 5,489,390 2/1996 Sivik et al. ..... 508/232

5,726,133 3/1998 Blakey et al. ..... 508/399

*Primary Examiner*—Jacqueline V. Howard

*Attorney, Agent, or Firm*—Ohlandt, Greeley, Ruggiero & Perle

[57] ABSTRACT

Multigrade crankcase lubricants having low concentrations of chlorine and sulphated ash use multifunctional viscosity modifiers in place of conventional chlorine-containing dispersants. The lubricant contains at least 1.5 weight percent of a chlorine-containing dispersant that is a reaction product of a polyisobutenyl succinic anhydride and an organic amine, a multifunctional viscosity modifier and a detergent system that comprises a metal sulfonateand one or more metal salts of a phenolic organic acid selected from the group consisting of alkyl phenols, sulfurized alkyl phenols, and alkyl salicylic acids in an amount that provides at least 0.0025 gram equivalents of phenolic hydroxide. At least one of the metal salts is overbased and the detergent system includes not more than 0.008 gram equivalent % carbonate. The gram equivalent ratio of the total amount of phenolic hydroxide to the metal sulfonate is at least 1.4 to 1 while the gram equivalent ratio of all the organic metal salts to carbonate is at least 0.5 to 1. The lubricant contains no more than 50 ppm chlorine as determined by neutron activation analysis and no more than 1.2 wt. % sulphated ash as determined by ASTM D874.

16 Claims, No Drawings

LOW CHLORINE, LOW ASH CRANKCASE LUBRICANT

This application is a 371 of PCT/EP96/04258 filed Sep. 24, 1996.

FIELD OF THE INVENTION

The present invention relates to multigrade crankcase lubricants. More particularly it relates to crankcase lubricants having low concentrations of chlorine and sulphated ash.

BACKGROUND

Some chlorine-containing organic compounds are known to be hazardous. In consequence a strong movement exists to limit the chlorine content of organic compounds. Thus, crankcase lubricant manufacturers in some countries specify that their finished lubricants must have less than 50 parts per million by weight (ppm) chlorine.

Conventional polyisobutenyl dispersants used in crankcase lubricants frequently contain chlorine. Chlorine is introduced into these compounds in two ways. First, the polymer backbone is made by cationic polymerisation of isobutene in the presence of a strong Lewis acid and a promoter, usually an organoaluminum compound. Then, a particularly efficient way to introduce a succinic group requires halogenating the polymer at an olefinic bond and subsequent maleation. In this process most of the chlorine is liberated as hydrogen chloride. A small amount of chlorine remains and is carried forward in the process to be present in the finished dispersant.

Crankcase lubricants made with these dispersants thus contain chlorine. When used at conventional levels, the lubricants contain chlorine at levels greater than the 50 ppm specification desired in many locations. Despite their chlorine content, continued use of these dispersants is desirable because known processes to make low chlorine or chlorine-free products are less flexible, use raw materials less efficiently, and are more likely to produce undesirable deposits in the reactor than the halogenation/maleation process. Additionally, plants to make chlorine-free polyisobutenyl succinic anhydride (PIBSA) are less numerous making the supply of chlorine-free PIBSA tight.

Lubricant formulations having a chlorine-containing dispersant and meeting the new low chlorine requirements must use less of the chlorine-containing dispersant while still achieving suitable performance. Thus non-conventional dispersants are required. Possible non-conventional dispersants include dispersants made from extremely low chlorine thermal polyisobutenyl succinic anhydride (see e.g. U.S. Pat. No. 5,356,552 and references cited therein) and viscosity modifiers that also function as dispersants.

Viscosity modifiers are materials added to crankcase lubricants to impart high and low temperature operability. Viscosity modifiers that have been post reacted to provide dispersancy are known as multi-functional viscosity modifiers or dispersant viscosity modifiers. Multigrade oils typically contain one or more viscosity modifiers. Thus, the viscosity modifier acts to increase viscosity at high temperature thereby providing more protection to the engine at high speeds, without unduly increasing viscosity at low temperatures which would otherwise making starting a cold engine difficult. High temperature performance is usually specified by kinematic viscosity (kV) at 100° C. (ASTM D445), while low temperature performance is specified in terms of cold cranking simulator (CCS) viscosity (ASTM D5293, which is a revision of ASTM D2602).

Viscosity grades are defined by the SAE Classification system according to these two measurements. SAE J300 defines the limits for kinematic viscosity and CCS as follows:

SAE VISCOSITY GRADES

| SAE viscosity grade | Maximum CCS Viscosity $10^{-3}$ Pa · s @ (° C.) | kV 100° C. $mm^2/s$ minimum | kV 100° C. $mm^2/s$ maximum |
|---|---|---|---|
| 0 W | 3250 (−30) | 3.8 | |
| 5 W | 3500 (−25) | 3.8 | — |
| 10 W | 3500 (−20) | 4.1 | — |
| 15 W | 3500 (−15) | 5.6 | — |
| 20 W | 4500 (−10) | 5.6 | — |
| 25 W | 6000 (−5) | 9.3 | — |
| 20 | — | 5.6 | <9.3 |
| 30 | — | 9.3 | <12.5 |
| 40 | — | 12.5 | <16.3 |
| 50 | — | 16.3 | <21.9 |
| 60 | — | 21.9 | <26.1 |

Multigrade oils meet the requirements of both low temperature and high temperature performance, and are thus identified by reference to both relevant grades. For example, an SAE 5W-30 multigrade oil has viscosity characteristics hat satisfy both the 5W and the 30 viscosity grade requirements—i.e. a maximum CCS viscosity of $3500\times10^{-3}$ Pa.s at −25° C., a minimum kV100° C. of 9.3 $mm^2/s$ and a maximum kV100° C. of <12.5 $mm^2/s$. Viscosity modifiers comprise polymers having an $\overline{M}n$ of at least 20,000. For ease of handling viscosity modifiers are usually employed as oil solutions of such polymers.

Use of multifunctional viscosity modifiers to provide dispersancy lost upon decreasing the amount of chlorine-containing dispersant is economically more attractive than use of other non-conventional dispersants. But multifunctional viscosity modifiers have been found to impact adversely high temperature deposits. This adverse effect is particularly evident in high temperature engine tests such as the PV 1431 Volkswagen Intercooled Turbo Diesel engine test and the Caterpillar 1G2 engine test.

At the same time, formulations having relatively low total sulphated ash are also desired. Extremely high levels of sulphated ash have been implicated in combustion chamber deposits. Thus, one automobile manufacturer recommends a maximum total ash level of 1.2 wt % as determined by ASTM D874.

Metal-containing or ash-forming detergents function both as detergents to reduce or remove deposits and as acid neutralisers. Detergents generally comprise a metal salt of an acidic organic compound, typically metal salts of sulfonates, phenates, sulfurized phenates, or salicylates. The salts may contain a substantially stoichiometric amount of the metal in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of organic salt surrounding cores of inorganic metal base (e.g. carbonate). Such overbased detergents may have a TBN of 150 or greater, and typically ranging from 250 to 450 or more.

While metal-containing detergents are useful to control high temperature deposits on the piston, the requirement for low sulphated ash exacerbates the problems associated with use of multi-functional viscosity modifier in lieu of conventional dispersant because it limits the formulator's ability to use larger amounts of metal-containing detergents.

Accordingly a need exists for a lubricant formulated with a chlorine-containing dispersant and multi-functional viscosity modifier that has low chlorine and maximum total sulphated ash not exceeding 1.2 wt %.

SUMMARY OF THE INVENTION

Multigraded lubricants comprising a chlorine-containing dispersant, a multifunctional viscosity modifier, and metal detergents are made by adding to a basestock of lubricating viscosity at least 1.5 weight percent active ingredient of a chlorine-containing dispersant that is a reaction product of polyisobutenyl succinic anhydride and an organic amine, a multifunctional viscosity modifier, and a detergent system that includes a metal sulfonate and one or more metal salts of a phenolic organic acid selected from the group consisting of alkyl phenols, sulfurized alkyl phenols, and alkyl salicylic acids in an amount that provides at least 0.0025 equivalents per 100 gm of lubricant (hereafter gm equivalent %) of phenolic hydroxide. At least one of the organic metal salts is overbased. The detergent system includes not more than 0.008 gram equivalent % carbonate. The ratio of the total gram equivalents of phenolic hydroxide to gram equivalents of sulfonate is at least 1.4 to 1. The equivalent ratio of all the organic salt detergents (sulfonates plus phenolic hydroxide) to carbonate is at least 0.5 to 1. The lubricant contains no more than 50 ppm chlorine as determined by neutron activation analysis and no more that 1.2 wt % sulphated ash (as determined by ASTM D874).

The metal-containing detergent system may comprise one or more alkali or alkaline earth metal salts of a sulfonate, a phenate, or a sulfurized phenate wherein at least one of the salts is overbased, i.e. having a TBN of at least 150, and the ratio of gram equivalents of phenolic hydroxide to gram equivalents of sulfonate is at least 2 to 1. Preferably the ratio of gram equivalents of phenolic hydroxide-to-gram equivalents of sulfonate does not exceed 2.5 to 1. In another embodiment the metal-containing detergent system comprises a mixture of sulfonate and salicylate salts. Preferably, at least one salt in the metal-containing detergent system is a magnesium salt.

In a further aspect of the invention, the formulation is substantially free of aromatic amines having at least two aromatic groups attached directly to the nitrogen, e.g., alkyl substituted diphenyl amines. If an aromatic amine having at least two aromatic groups attached directly to the nitrogen is to be included, it should be present at a level not exceeding 0.4 wt % active ingredient.

In yet another aspect of the invention, the lubricant includes a fluoroelastomer seal passivating agent comprised of tetrapropenyl succinic anhydride and polyisobutenyl succinic anhydride (PIBSA) in a weight ratio of at least 3 to 1. Preferably the PIBSA is made from a polyisobutene having a relatively low molecular weight, for example an $\overline{M}n$ of less than 1 0,000. Typically, the PIBSA will be made as described above and will therefore contain chlorine. Any chlorine added in the PIBSA must be taken into account.

The invention also comprises an additive package comprising the dispersant and the detergent system in concentrated form plus additional additives that are compatible with the dispersant and detergent system. In use, the additive package is diluted in basestock and the viscosity modifier is added to make the finished multigraded lubricant. The concentrate of the present comprises a chlorine-containing dispersant, a detergent system, and at least one additional additive from the group consisting of antioxidants, antiwear agents, corrosion inhibitors, friction modifiers, antifoamants, demulsifiers, and rust inhibitors. It is prepared by preblending at a temperature of at least 100° C. for a period of 1 to 10 hours a mixture comprising at least 15 weight percent active ingredient of a dispersant that is a reaction product of a chlorine-containing polyisobutenyl succinic anhydride and an organic amine with a detergent system comprising a metal sulfonate and at least 0.025 equivalents of phenolic hydroxide. At least one of the metal salts is overbased and the package contains not more than 0.04 moles of carbonate. The ratio of the total gram equivalents of phenolic hydroxide to gram equivalents of sulfonate is at least 1.4 to 1; the ratio of the total gram equivalents of sulfonate plus the total equivalents of phenolic hydroxide to equivalents of carbonate is at least 0.5 to 1. Upon completion of the preblend, the mixture is cooled to a temperature not greater than 85° C. and at least one additional additive is added.

DETAILED DESCRIPTION

A. Basestock

The basestock used in the lubricating oil may be selected from any of the synthetic or natural oils used as crankcase lubricating oils for spark-ignited and compression-ignited engines. The lubricating oil base stock conveniently has a kinematic viscosity of 2.5 to 12 $mm^2/s$ and preferably 2.5 to 9 $mm^2$1s at 100° C. The viscosity characteristic of a basestock is typically expressed by the neutral number of the oil (e.g., S150N) with a higher neutral number being associated with a higher viscosity at a given temperature. This number is defined as the viscosity of the basestock at 40° C. measured in Saybolt Universal Seconds. The average basestock neutral number (ave. BSNN) of a blend of straight cuts may be determined according to the following formula:

$$\log(ave.BSNN) = \left[BSR1 \times \log\frac{BSNN1}{100}\right] + \left[BSR2 \times \log\frac{BSNN2}{100}\right] + \ldots \left[BSR2 \times \log\frac{BSNN2}{100}\right]$$

where $BSRn$ = basestock ratio for basestock $n$

= (wt. % basestock n / wt. % total basestock in oil) × 100 %

$BSNNn$ = basestock neutral number for basestock $n$

Basestocks with lower solvent neutral numbers are used for lower viscosity grades. For example, typically basestock will have a BSNN between 90 and 180. Mixtures of synthetic and natural base oils may be used if desired.

B. Chlorine-containing Polyisobutenyl Dispersant

The chlorine-containing dispersant comprises a polyisobutylene polymer such as may be prepared by polymerisation of a $C_4$ refinery stream. Suitable polymers may be prepared by cationic polymerisation of hydrocarbon $C_4$ feed streams in the presence of a strong Lewis acid catalyst and a reaction promoter, usually an organoaluminum such as HCl or ethylaluminum dichloride. Tubular or stirred reactors may be used. Such polymerizations and catalysts are described, e.g., in U.S. Pat. Nos. 4,935,576 and 4,952,739. Fixed bed catalyst systems may also be used as in U.S. Pat. No. 4,982,045 and UK-A 2,001,662. Most commonly, polyisobutylene polymers are derived from Raffinate I refinery feed streams.

The oil soluble polyisobutene backbone will usually have a number average molecular weight ($\overline{M}n$) within the range of from 300 to 20,000. The $\overline{M}n$ of the backbone is preferably within the range of 500 to 10,000, more preferably 700 to 5,000. Particularly useful polyisobutene polymers for use in dispersants have $\overline{M}n$ within the range of from 1500 to 3000. The $\overline{M}n$ for such polymers can be determined by several known techniques. A convenient method for such determination is by gel permeation chromatography (GPC) which additionally provides molecular weight distribution information; see W. W. Yau, J. J. Kirkland and D. D. Bly, "Modern Size Exclusion Liquid Chromatography", John Wiley and Sons, New York, 1979.

The oil soluble polyisobutene backbone is halogenated at an olefinic bond and subsequently reacted with maleic acid or anhydride. Alternatively, the succinic group may be introduced by thermal reaction of maleic anhydride with the polymer absent halogenation. The resulting polyisobutenyl succinic acid or anhydride is then further derivatized with a nucleophilic organic amine, amino-alcohol, or mixture thereof to form predominately the imide plus varying amounts of oil soluble salts, amides, amino-esters, and oxazolines. Useful amine compounds include mono- and (preferably) polyamines, most preferably polyalkylene polyamines, of 2 to 60, preferably 2 to 40 (e.g. 3 to 20), total carbon atoms and 1 to 12, preferably 3 to 12 and most preferably 3 to 9 nitrogen atoms in the molecule. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Useful amine compounds for derivatizing functionalized polymers comprise at least one amine and can comprise one or more additional amine or other reactive or polar groups. Preferred amines are aliphatic saturated amines. Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. Mixtures of amine compounds may advantageously be used such as those prepared by reaction of alkylene dihalide with ammonia. Useful amines also include polyoxyalkylene polyamines. A particularly useful class of amines are the polyamido and related amido-amines as disclosed in U.S. Pat. Nos. 4,857,217; 4,956,107; 4,963,275; and 5,229,022. Also useable is tris(hydroxymethyl)amino methane. Dendrimers, star-like amines, and comb-structure amines may also be used. Similarly, one may use the condensed amines of Steckel U.S. Pat. No. 5,053,152.

A preferred group of polyisobutenyl succinimides includes those derived from polyisobutylene substituted with succinic anhydride groups and reacted with polyethylene amines (e.g. tetraethylene pentamine, pentaethylene, polyoxypropylene diamine) or aminoalcohols (e.g., trismethylolaminomethane) and optionally additional reactants such as alcohols and reactive metals e.g. pentaerythritol, and combinations thereof. Preferably, the functionalized polymer contains less than 2000 ppm chlorine (on an active ingredient basis). When it contains less than 2000 ppm chlorine, its chlorine contribution to the finished lubricant is sufficiently small that the total chlorine level can be kept below 50 ppm. For example a dispersant made from a PIBSA having 2000 ppm chlorine may have 1075 ppm chlorine after it has been aminated and post treated. When that dispersant is added to a finished lubricant at 1.7 wt % it contributes 18 ppm chlorine to the lubricant. Clearly, lower chlorine levels, e.g. 1000 ppm are preferred.

The functionalized polymer of this invention is reacted with the amine compound according to conventional techniques as in EP-A 208,560 and U.S. Pat. No. 5,229,022 using any of a broad range of reaction ratios as described therein.

The polyisobutenyl dispersant can be further post-treated by a variety of conventional post treatments such as boration as generally taught in U.S. Pat. Nos. 3,087,936 and 3,254,025. This is readily accomplished by treating an acyl nitrogen dispersant with a boron compound selected from the class consisting of boron oxide, boron halides, boron acids and esters of boron acids in an amount to provide from 0.1 atomic proportion of boron for each mole of the acylated nitrogen composition to 20 atomic proportions of boron for each atomic proportion of nitrogen of the acylated nitrogen composition. Usefully the dispersants contain from 0.05 to 2.0 wt. %, e.g. 0.05 to 0.7 wt. %, boron based on the total weight of the borated acyl nitrogen compound. The boron, which appears to be in the product as dehydrated boric acid polymers (primarily $(HBO_2)_3$), is believed to attach to the dispersant imides and diimides as amine salts e.g. the metaborate salt of the diimide.

Boration is readily carried out by adding from 0.05 to 4 wt %, e.g. 1 to 3 wt. %, (based on the weight of acyl nitrogen compound) of a boron compound, preferably boric acid, which is usually added as a slurry to the acyl nitrogen compound and heating with stirring at from 135° C. to 190°, e.g. 140°–170° C., for from 1 to 5 hours followed by nitrogen stripping. Or, the boron treatment can be carried out by adding boric acid to a hot reaction mixture of the dicarboxylic acid material and amine while removing water.

C. Viscosity Modifiers

Multifunctional viscosity modifiers impart high and low temperature operability to the lubricant and also function as dispersants. They comprise an oil soluble polymeric hydrocarbon backbone which will usually have a weight average molecular weight, $\overline{M}w$, greater than 20,000, typically from 20,000 up to 500,000 or greater. In general, these dispersant viscosity modifiers are functionalized polymers. For example the viscosity modifier may be an inter-polymer of ethylene-propylene post grafted with an active monomer such as maleic anhydride and then derivatized with, for example, an alcohol or amine.

Suitable compounds are generally high molecular weight hydrocarbon polymers, including polyesters. Oil soluble viscosity modifying polymers generally have weight average molecular weights of from 10,000 to 1,000,000, preferably 20,000 to 500,000, which may be determined by gel permeation chromatography (as described above) or by light scattering.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Typically, dispersancy functionality is introduced by post reacting a viscosity modifier polymer to introduce polar groups. See for example U.S. Pat. No. 4,517,104, U.S. Pat. No. 4,780,228, U.S. Pat. No. 4,699,723, and U.S. Pat. No. 4,948,524. Free radical functionalization of star and block copolymers of hydrogenated diene styrene is described in U.S. Pat. No. 5,049,294. If the viscosity modifier is a polymethacrylate, dispersancy may be introduced when the polymer is made by incorporating a small amount of nitrogen-containing monomer such as vinylpyridine as described in U.S. Pat. No. 4,618,439. A particularly preferred multifunctional viscosity modifier and a method for making it are described in U.S. Pat. No. 5,427,702 and U.S. Pat. No. 5,424,367 both of which are incorporated by reference.

The multifunctional viscosity modifier used in the invention will be used in an amount to give the required viscosity characteristics. Since they are typically used in the form of oil solutions, the amount of additive employed will depend on the concentration of polymer in the oil solution comprising the additive. However by way of illustration, typical oil solutions of polymer used as viscosity modifiers are used in amounts of from 1 to 30% of the blended oil. The amount of viscosity modifier used as active ingredient of the oil is generally from 0.01 to 6 wt %, and more preferably from 0.1 to 2 wt %.

D. Metal-containing Detergent System

Metal-containing or ash-forming detergents function both as detergents to reduce or remove deposits and as acid neutralisers or rust inhibitors, thereby reducing wear and corrosion and extending engine life. Detergents generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralised detergent surrounding a core of inorganic metal base (e.g., hydrated carbonates). Such overbased detergents may have a TBN of 150 or greater, and typically ranging from 250 to 450 or more.

Detergents that may be used include oil-soluble neutral and overbased sulfonates, phenates, sulfurized phenates, and salicylates of a metal, particularly the alkali or alkaline earth metals, e.g., sodium, potassium, lithium, calcium, and magnesium. The most commonly used metals are calcium and magnesium, which may both be present. Mixtures of calcium and/or magnesium with sodium are also useful. Particularly convenient metal detergents are neutral and overbased calcium or magnesium sulfonate having TBN of from 20 to 450 TBN, neutral and overbased calcium or magnesium phenates and sulfurized phenates having TBN of from 50 to 450, and neutral or overbased calcium or magnesium salicylates having TBN of from 130 to 350. Mixtures of such salts may also be used. For the present invention at least one metal salt is overbased.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from 3 to more than 70 carbon atoms. The alkaryl sulfonates usually contain from 9 to 80 or more carbon atoms, preferably from 16 to 60 carbon atoms per alkyl substituted aromatic moiety.

The oil-soluble sulfonates or alkaryl sulfonic acids may be neutralised with oxides, hydroxides, alkoxides, carbonates, carboxylate, sulphides, hydrosulfides, nitrates, borates and ethers of the alkali metal. The amount of metal compound is chosen having regard to the desired TBN of the final product but typically ranges from 100 to 220 wt % (preferably at least 125 wt %) of that stoichiometrically required.

Metal salts of alkyl phenols and sulfurized alkyl phenols are prepared by reaction with an appropriate metal compound such as an oxide, hydroxide or alkoxide, and overbased products may be obtained by methods well known in the art. Sulfurized alkyl phenols may be prepared by reacting an alkyl phenol with sulphur or a sulphur-containing compound such as hydrogen sulphide, sulphur monohalide or sulphur dihalide, to form products which are generally mixtures of compounds in which 2 or more phenols are bridged by sulphur-containing bridges. The starting alkyl phenol may contain one or more alkyl substituents. These may be branched or unbranched, and depending on the number of substituents may have from 1 to 30 carbon atoms (provided the resulting alkyl phenol is oil-soluble), with from 9 to 18 carbon atoms being preferred. Mixtures of alkyl phenols with different alkyl substituents may be used.

Metal salts of carboxylic acids (including salicylic acids) may be prepared in a number of ways: for example, by adding a basic metal compound to a reaction mixture comprising the carboxylic acid (which may be part of a mixture with another organic acid such as a sulfonic acid) or its metal salt and promoter, and removing free water from the reaction mixture to form an metal salt, then adding more basic metal compound to the reaction mixture and removing free water from the reaction mixture. The carboxylate is then overbased by introducing the acidic material such as carbon dioxide to the reaction mixture while removing water. This can be repeated until a product of the desired TBN is obtained.

The overbasing process is well known in the art and typically comprises reacting acidic material with a reaction mixture comprising the organic acid or its metal salt, a metal compound. That acidic material may be a gas such as carbon dioxide or sulphur dioxide, or it may be boric acid. Processes for the preparation of overbased alkali metal sulfonates and phenates are described in EP-A-266034. A process suitable for overbased sodium sulfonates is described in EP-A-235929. A process for making overbased salicylates is described in EP-A-351052.

The overbased metal detergents can be borated. The boron may be introduced by using boric acid as the acidic material used in the overbasing step. However a preferred alternative is to borate the overbased product after formation by reacting a boron compound with the overbased metal salt. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. Boric acid is preferred. Generally, the overbased metal salt may be reacted with a boron compound at from 50° C. to 250° C., in the presence of a solvent such as mineral oil or xylene. The borated, overbased alkali metal salt preferably comprises at least 0.5%, preferably from 1% to 5%, by weight boron.

E. Seal Passivating Agent

Multi functional viscosity modifiers tend to be aggressive toward fluoroelastomer seals. In one aspect of present invention, the lubricant includes a fluoroelastomer seal passivating agent comprised of tetrapropenyl succinic anhydride and polyisobutenyl succinic anhydride in a weight ratio of at least 3 to 1 and conveniently 4 to 1. Tetrapropenyl succinic anhydride is readily available. The PIBSA is typically made as described above. Preferably the PIBSA is made from a polyisobutene having a relatively low molecular weight, for example an $\overline{M}n$ of less than 10,000. Conveniently the tetrapropenyl succinic anhydride may be used at 0.07 to 0.35 weight % while the PIBSA is used at 0.02 to 0.088 weight %.

F. Other Detergent Inhibitor Package Additives

Additional additives are typically incorporated into the compositions of the present invention. Examples of such additives are antioxidants, anti-wear agents, corrosion inhibitors, friction modifiers, rust inhibitors, anti-foaming agents, demulsifiers, and pour point depressants.

Dihydrocarbyl dithiophosphate metal salts are frequently used as anti-wear and antioxidant agents. The metal may be an alkali or alkaline earth metal, or aluminium, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralising the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil soluble salts of dihydrocarbyl dithiophosphoric acids and may be represented by the following formula:

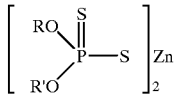

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulphide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. While these materials may be used in small amounts, preferred embodiments of the present invention are free of these compounds. They are preferably used in only small amounts, i.e., up to 0.4 wt %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 wt % active ingredient.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate. Other friction modifiers are known. Among these are esters formed by reacting carboxylic acids and anhydrides with alkanols. Other conventional friction modifiers generally consist of a polar terminal group (e.g.

carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of non-ionic polyoxyalkylene polyols and esters thereof, polyoxyalkylene phenols, and anionic alkyl sulfonic acids may be used.

Copper and lead bearing corrosion inhibitors may be used. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No.1,560,830. Benzotriazoles derivatives also fall within this class of additives.

A small amount of a demulsifying component may be used. A preferred demulsifying component is described in EP 330,522. It is obtained by reacting an alkylene oxide with an adduct obtained by reacting a bis-epoxide with a polyhydric alcohol. This demulsifier may be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

When lubricating compositions contain one or more of the above-mentioned additives, each additive is typically blended into the base oil in an amount which enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Dispersant | 1.5–3.0 | 1.7 to 2.0 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–2 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Elastomer compatibility aid | 0–0.4 | 0.02–0.3 |
| Multifunctional Viscosity Modifier | 0.01–6 | 0.4–4 |
| Mineral or Synthetic Base Oil | Balance | Balance |

The components may be incorporated into a base oil in any convenient way. Thus, each of the components can be added directly to the oil by dispersing or dissolving it in the oil at the desired level of concentration. The individual components may be singly or in sub-combinations. Thus the detrgent system is present when indiviudal detergents are added so that collectively the features of the system are present. Such blending may occur at ambient temperature or at an elevated temperature.

Preferably all the additives except for the viscosity modifier and the pour point depressant are blended into a concentrate or additive package described, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

While the dispersant and individual detergent components may be added to the concentrate singly, a particulary preferred concentrate is made by preblending the dispersant with the entire detergent system in accordance with the method described in U.S. Pat. No. 4,938,880. That patent describes making a premix of dispersant and metal detergents that is pre-blended at a temperature of at least about 100° C. for a period of 1 to 10 hours. Thereafter the pre-mix is cooled to at least 85° C. and the additional components are added. When the amount of dispersant is low compared to typical formulations, as required for the present invention, it is preferable to pre-blend all of the metal detergents with the dispersant. Further the tetrapropenyl succinic anhydride should be added late (e.g. after any zinc dialkyldithiophosphate) or even last in the blend order.

The final formulations may employ from 2 to 15 mass % and preferably 5 to 15 mass %, typically about 10 mass % of the concentrate or additive package with the remainder being base oil.

When calculating the amounts of the various components present in the final lubricant, the compositions of the individual components may be taken as a starting point and adjusted for their respective treat rates. The compositions of metal detergents are not known with certainty. For example sulfurized metal phenates are generally described as bis-thio-phenates with sulfur linkages of varying lengths. In fact the number of phenolic groups actually linked together is not known with certainty. Similarly, the amount of phenol assumed to convert to a metal salt is often assumed to be 100%. In fact the degree of the neutralization depends on the acidity of the phenol and the acidity of the nuetralizing base. Further the equilibria established when the component is made shift whenever the component is blended with other materials containing strong bases. For these reasons, the amounts of carbonate, sulfonate, and phenolic hydroxide present in a lubricant are inferred from the amounts present in the individual components that are blended to make the finished lubricant. And those amounts are in turn inferred from the charge ratios of raw materials used to make the detergents or by resort to analytical methods that can determine detectable moieties allowing inference of the remaining moieties.

Thus the amount of sulfonate salt present in a sulfonate detergent may be determined by using the liquid chromatography method described in ASTM D3712. Alternatively the amount of sulfonate may be determined by two phase titration as described by Epton, Trans. Far. Soc., April 1948 page 226. The total amount of metal may be determined by inductively coupled plasma atomic emission spectroscopy—ASTM D4951. The amount of carbonate present in a sulfonate detergent can be inferred from the amount of organic salt and the total amount of metal.

Determination of the amount of phenolic hydroxide present is possible either by knowing the number of equivalents of phenol charged to make the metal detergent or by dialysing the detergent, treating the dialysis residue with strong acid to convert any salts to their respective acid form and measuring the hydroxide number of the mixture by the method described in ASTM D1957. If the detergent contains non-phenolic hydroxyl groups on the phenolic compound (e.g., alcoholic derivatives of ethylene glycol used in manufacture of commercial phenates or carboxylic acid groups on salicylic acid), separate analyses must be conducted to quantify the amounts of those hydroxyl groups so that the hydroxide number determined by ASTM D1957 can be corrected. Suitable techniques to determine the quantity of non-phenolic hydroxyl groups include analyses by mass spectroscopy, liquid chromatography, and proton NMR and correlation to compounds having known properties.

While the foregoing methods to determine amounts of organic salts present in detergent are at best approximations and differing methods will not always give exactly the same result, they are sufficiently precise to allow determination of whether the gram equivalent levels and ratios required by the present invention are met.

The amounts of chlorine and sulphated ash may be determined either by adding up the chlorine and sulphated ash levels of the individual materials blended together to make the finished lubricant or by analysing the lubricant itself. Chlorine levels may be determined by neutron activation analysis. Neutron Activation Analysis is described by Parry, S. J., "Neutron Activation Analysis', *Encyclopaedia of Analytical Science,* (A. Townsend, ed.) Academic Press 1995. Sulphated ash is determined according the method described in ASTM D874.

The amount of dispersant in a finished lubricant may be determined by dialysing the lubricant to separate all non-polymeric materials and then analysing the remaining mixture of polymers (largely the dispersant, viscosity modifier and lube oil flow improver) by GPC.

The invention will now be described by way of illustration only with reference to the following examples. In the examples, unless otherwise noted, all treat rates of all additives are reported as mass percent active ingredient. Example 1 and comparative examples A to C are fully formulated oils comprising basestock, chlorine-containing dispersant, multifunctional viscosity modifier, a detergent system, an antioxidant/antiwear system, an antifoam agent, a demulsifier, and a seal passivating system. The performance of the lubricants shows that meeting the required chlorine level, the required sulphated ash level and obtaining satisfactory high temperature deposit performance (for example passing the Volkswagen Intercooled Turbo Diesel Engine Test) requires substituting multi-functional viscosity modifier for the chlorine-containing dispersant and using the detergent system of the present invention both to compensate for the poorer diesel deposit performance of the multifunctional viscosity modifier and to keep within the total sulphated ash level.

TABLE 1

| | Example | | | |
|---|---|---|---|---|
| | 1 | A | B | C |
| Borated PIBSA:Polyamine | 1.70 | 0.99 | 1.70 | 1.70 |
| Mixed Mg & Ca sulfonates | 1.11 | 1.11 | 1.66 | 1.11 |
| Ca sulfurized alkyl phenate, | 0.75 | 0.27 | 0.75 | 0.50 |

TABLE 1-continued

| | Example | | | |
|---|---|---|---|---|
| | 1 | A | B | C |
| (126 TBN) | | | | |
| Sulphurised alkyl phenol | — | — | — | 0.33 |
| Tetrapropenyl succinic anhydride (TPSA) | 0.25 | 0.25 | 0.25 | 0.25 |
| PIBSA, (950 M. Wt. PIB) | 0.07 | 0.07 | 0.07 | 0.07 |
| Multifunctional Viscosity Modifier (wt % polymer) | 1.37 | 1.37 | 1.37 | 1.37 |
| Wt ratio TPSA/PIBSA | 3.57 | 3.57 | 3.57 | 3.57 |
| Gram equivalent % sulfonate | 0.0012 | 0.0012 | 0.0016 | 0.0012 |
| Gram equivalent % phenolic hydroxide | 0.0026 | 0.0009 | 0.0026 | 0.0017 |
| Gram equivalent % total sulfonate + phenolic hydroxide | 0.0038 | 0.0021 | 0.0042 | 0.0029 |
| Gram equivalent ratio phenolic hydroxide/sulfonate | 2.17 | 0.75 | 1.62 | 1.42 |
| Gram equivalent % carbonate | 0.0073 | 0.0073 | 0.0126 | 0.0073 |
| Gram equivalent ratio total sulfonate + phenolic hydroxide/carbonate | 0.52 | 0.29 | 0.33 | 0.40 |
| Total sulfated ash | 1.20 | 1.20 | 1.60 | 1.15 |
| Total Chlorine | 43 | 30 | 43 | 70 |
| VWINTD | pass | (fail) | (pass) | (marginal pass) |

The VWINTD results in brackets are predicted results from a knowledge of formulation response.

I claim:

1. A multigrade lubricant composition comprising a basestock of lubricating viscosity and at least 1.5 weight percent of a chlorine-containing dispersant that is a reaction product of polyisobutenyl succinic anhydride and an organic amine, a multifunctional viscosity modifier, and a metal-containing detergent system that comprises a metal sulfonate, and one or more metal salts of a phenolic organic acid selected from the group consisting of alkyl phenols, sulfurized alkyl phenols, and alkyl salicylic acids in an amount that provides at least 0.0025 gram equivalent % of phenolic hydroxide, wherein at least one of the metal sulfonate or metal salts is overbased and the detergent system includes not more than 0.008 gram equivalent % carbonate, and the ratio of the total gram equivalents of phenolic hydroxide to the gram equivalents of metal sulfonate is at least 1.4 to 1, the gram equivalent ratio of all the organic metal salts to carbonate is at least 0.5 to 1, and wherein the lubricant composition contains no more than 50 ppm chlorine as determined by neutron activation analysis and no more that 1.2 wt % sulphated ash as determined by ASTM D874.

2. The lubricant composition of claim 1 wherein the dispersant comprises at least 1.8 wt % of the lubricant and is made from a polyisobutene having an $\overline{Mn}$ of at least 900.

3. The lubricant composition claim 2 wherein the metal-containing detergent system comprises at least one alkali or alkaline earth metal sulfonate and at least one alkali or alkaline earth metal sulfurized phenate wherein the gram equivalent ratio of phenolic hydroxide to sulfonate is from 2:1 to 2.5:1.

4. The lubricant composition of claim 2 wherein the metal-containing detergent system comprises at least one alkali or alkaline earth metal sulfonate and at least one alkali or alkaline earth metal salicylate.

5. The lubricant composition of claim 4 wherein the metal-containing detergent system includes at least one magnesium salt of an oil soluble organic acid.

6. The lubricant composition of claim 1 wherein the lubricant further comprises from 0.07 to 0.35 mass percent of tetrapropenyl substituted succinic anhydride and at least 0.02 to 0.088 mass percent polyisobutenyl succinic anhydride provided further that the mass ratio of tetrapropenyl succinic anhydride to polyisobutenyl succinic anhydride is at least 3 to 1.

7. The lubricant composition of claim 1 that has no more than 0.4 wt % of an oil soluble aromatic amine having at least two aromatic groups attached directly to one amine nitrogen.

8. A multigrade crankcase lubricant composition comprising a basestock of lubricating viscosity and:

at least 1.7 weight percent of a chlorine-containing dispersant that is a reaction product of polyisobutenyl succinic anhydride having between 1000 and 2000 ppm chlorine and an organic amine wherein the polyisobutene used to make the polyisobutenyl succinic anhydride has a $\overline{Mn}$ within the range of from 1500 to 3000, a multifunctional viscosity modifier at a level of from 1 to 2 weight percent polymer wherein the polymer is an ethylene-propylene copolymer that has been maleic anhydride grafted and aminated with polyalkylene amine, a detergent system that comprises:

a mixture of calcium and magnesium sulfonates and calcium sulphurised alkyl phenol in an amount that provides at least 0.0025 mole % phenolic hydroxide, wherein at least one of the calcium or magnesium sulfonates or the calcium sulfurized alkyl phenate is overbased and the detergent system includes not more than 0.008 gram equivalent % carbonate, and the gram equivalent ratio of phenolic hydroxide to the total gram equivalents of calcium and magnesium sulfonates is at least 2 to 1, the gram equivalent ratio of all the sulfonate plus the phenolic hydroxide to carbonate is at least 0.5 to 1, and the lubricant composition contains no more than 50 ppm by weight chlorine as determined by neutron activation analysis and no more that 1.2 wt % sulphated ash as determined by ASTM D874.

9. A method of preparing an additive package concentrate comprising a chlorine-containing dispersant, a detergent system, and at least one additional additive from the group consisting of antioxidants, antiwear agents, corrosion inhibitors, friction modifiers, antifoamants, demulsifiers, and rust inhibitors comprising:

preblending, at a temperature of at least 100° C. for a period of 1 to 10 hours, a mixture comprising: at least 15 weight percent of a dispersant that is a reaction product of a chlorine-containing polyisobutenyl succinic anhydride and an organic amine with a detergent system comprising a metal sulfonate and one or more metal salts of a phenolic organic acid selected from the group consisting of alkyl phenols, sulfurized alkyl phenols, and alkyl salicylic acids in an amount that provides at least 0.025 gram equivalents of phenolic hydroxide, wherein at least one of the metal salts is overbased and the package contains not more than 0.04 moles of carbonate and the gram equivalent ratio of the total amount phenolic hydroxide to the metal sulfonate is at least 1.4 to 0.1, and the gram equivalent ratio of all the organic metal salts to carbonate is at least 0.5 to 1, and thereafter cooling the mixture to a temperature not greater than 85° C. and adding the at least one additional additive.

10. A method of improving high temperature deposit performance of mutigrade lubricants in the Volkswagen Intercooled Turbo Diesel Engine Test, wherein the lubricant contains no more than 50 ppm by weight chlorine as determined by neutron activation analysis and no more than 1.2 wt % sulphated ash as determined by ASTM D874, the method comprising adding to a basestock of lubricating viscosity:

at least 1.5 weight percent of a chlorine-containing dispersant that is a reaction product of polyisobutenyl succinic anhydride and an organic amine, a multifunctional viscosity modifier, and a metal-containing detergent system that comprises a metal sulfonate, and one or more metal salts of a phenolic organic acid selected from the group consisting of alkyl phenols, sulfurized alkyl phenols, and alkyl salicylic acids in an amount that provides at least 0.0025 gram equivalent % of phenolic hydroxide, wherein at least one of the metal sulfonate or metal salts is overbased and the detergent system includes not more than 0.008 gram equivalent % carbonate, and the ratio of the total gram equivalents of phenolic hydroxide to the gram equivalents of metal sulfonate is least 1.4 to 1, the gram equivalent ratio of all the organic metal salts to carbonate is at least 0.5 to 1.

11. The method composition of claim 10 wherein the dispersant comprises at least 1.8 wt % of the lubricant and is made from a polyisobutene having an $\overline{Mn}$ of at least 900.

12. The method composition of claim 11 wherein the metal-containing detergent system comprises at least one alkali or alkaline earth metal sulfonate and at least one alkali or alkaline earth metal sulfurized phenate wherein the gram equivalent ratio of phenolic hydroxide to sulfonate is from 2:1 to 2.5:1.

13. The method composition of claim 11 wherein the metal-containing detergent system comprises at least one alkali or alkaline earth metal sulfonate and at least one alkali or alkaline earth metal salicylate.

14. The method composition of claim 13 wherein the metal-containing detergent system includes at least one magnesium salt of an oil soluble organic acid.

15. The method composition of claim 10 wherein the lubricant further comprises from 0.07 to 0.35 mass percent of tetrapropenyl substituted succinic anhydride and at least 0.02 to 0.088 mass percent polyisobutenyl succinic anhydride provided further that the mass ratio of tetrapropenyl succinic anhydride to polyisobutenyl succinic anhydride is at least 3 to 1.

16. The method composition of claim 10 that has no more than 0.4 wt % of an oil soluble aromatic amine having at least two aromatic groups attached directly to one amine nitrogen.

* * * * *